United States Patent [19]

Bonnice

[11] 3,990,192

[45] Nov. 9, 1976

[54] METHOD FOR IMPROVING SURFACE FINISH OF WORKPIECES GROUND WITH ABRASIVE WHEELS

[75] Inventor: Phillip E. Bonnice, Worthington, Ohio

[73] Assignee: General Electric Company, Columbus, Ohio

[22] Filed: Dec. 20, 1974

[21] Appl. No.: 535,017

[52] U.S. Cl. ..... 51/325; 51/206 R; 51/327; 125/11 CD

[51] Int. Cl.[2] ..... B24B 1/00

[58] Field of Search ..... 125/11 R, 11 CD; 51/263, 209, 161, 365, 306, 292, 295, 326, 327, 325, 206

[56] References Cited

UNITED STATES PATENTS

| | | | |
|---|---|---|---|
| 2,332,992 | 10/1943 | Davis | 51/263 X |
| 2,681,274 | 6/1954 | Young | 51/305 |
| 2,904,419 | 9/1959 | Couch | 51/295 |
| 3,314,410 | 4/1967 | Knauer | 125/11 R |

*Primary Examiner*—Harold D. Whitehead
*Attorney, Agent, or Firm*—Granville M. Pine; Edward A. Hedman; Donald J. Voss

[57] ABSTRACT

The surface finishes of workpieces ground with cubic boron nitride, diamond or similar grinding wheels is improved by applying a lapping composition comprising a multiplicity of fine grit abrasive particles dispersed in a normally solid but friction-meltable organic polymeric matrix against the rotating wheel, during spark out, and causing the lapping composition to melt and form a layer on the surface of the wheel and applying the lapping layer against the workpiece until the desired surface finish is achieved.

10 Claims, 4 Drawing Figures

METHOD FOR IMPROVING SURFACE FINISH OF WORKPIECES GROUND WITH ABRASIVE WHEELS

This invention relates to a method to improve the surface finish of a workpiece ground with an abrasive grinding wheel.

BACKGROUND OF THE INVENTION

In machine grinding operations, abrasive surfaced cubic boron nitride, diamond, silicon carbide, aluminum oxide and similar grinding wheels are used. Normally, and especially with the cubic boron nitride and diamond wheels, a somewhat rough surface is produced because of the sharp, free cutting action of the abrasive grains. This can cause customer concern and end user confusion, and, although improved finish can be sometimes obtained, it is at the expense of stock removal capability.

It is an objective of this invention to improve the resultant surface finish produced by such efficient grinding wheels, without altering their inherent high stock removal capability.

It has now been discovered that such grinding wheels can be converted, in situ, to wheels having a lapping capability, and this results in workpieces having highly improved surface finishes.

SUMMARY OF THE INVENTION

According to the present invention, the surface finishes of workpieces ground with cubic boron nitride, diamond or similar grinding wheels is improved by applying a lapping composition comprising a multiplicity of fine grit abrasive particles dispersed in a normally solid but friction-meltable organic polymeric matrix against the rotating wheel during spark out and causing the lapping composition to melt and form a layer on the surface of the wheel applying the lapping layer against the workpiece until the desired surface finish is achieved.

BRIEF DESCRIPTION OF THE DRAWINGS

The invention may be more readily understood by reference to the accompanying drawings in which.

DETAILED DESCRIPTION OF THE INVENTION

Figure 1:
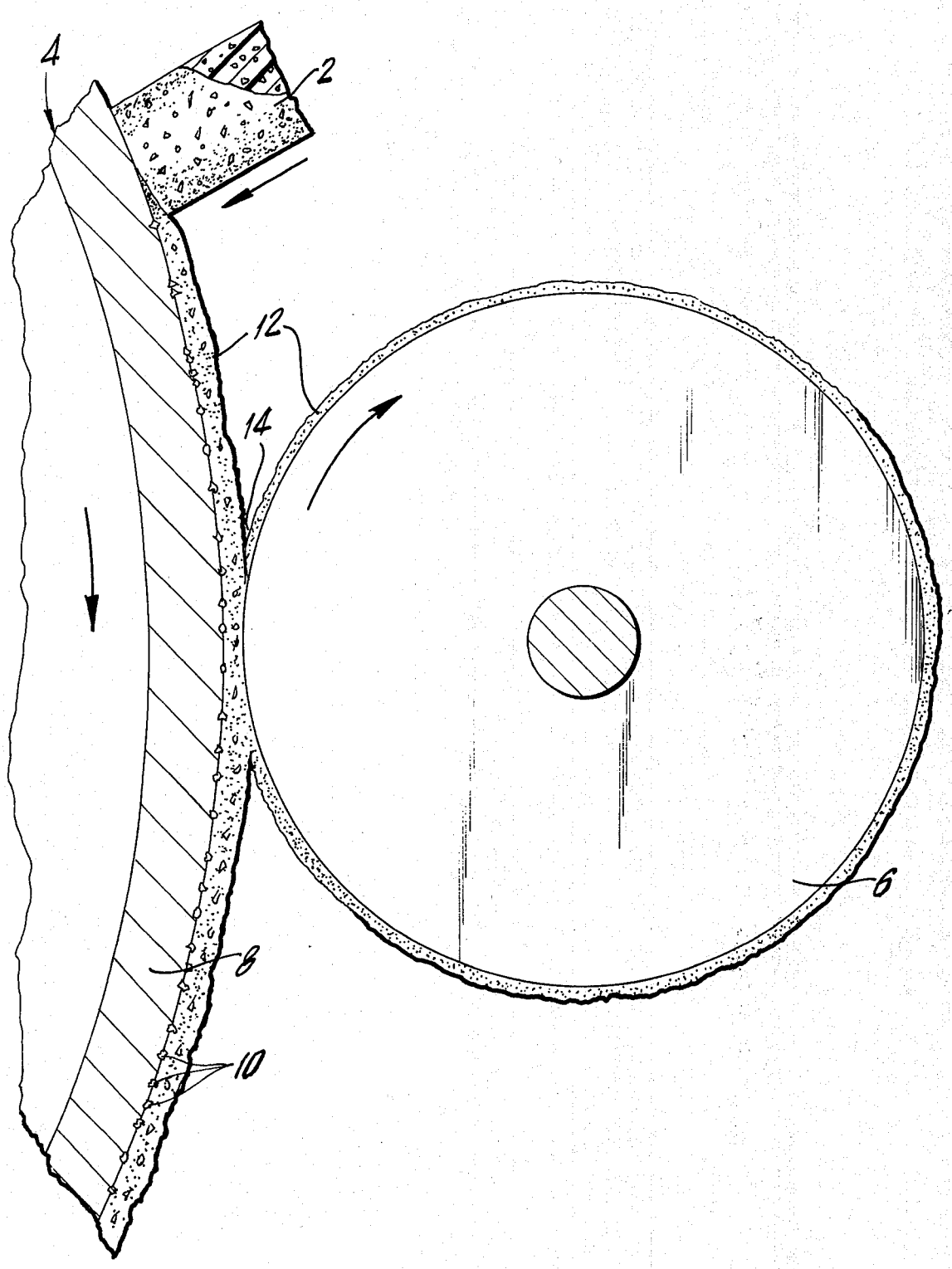
FIG. 1 is a schematic view showing a grinding wheel lapping stick being applied to the surface of a cylndrical grinding wheel causing a lapping film to form and contact a workpiece.

All of the following sizes, speeds and materials are illustrative only. Referring to FIG. 1, lapping stick 2 is made by i. melting a quantity of polyethylene glycol (PEG) of molecular weight of 1300–1600, 43–45° C. melting point (Baker Type U-220 or equivalent);

ii. adding a large quantity of 25 micron aluminum oxide grit at a mix ratio of 0.6 g. of $Al_2O_3$ per ml. of polyethylene glycol;

iii. stirring the mixture until completely mixed and the PEG begins to solidify;

iv. pouring the mixture into a mold and cooling (a refrigerator can be used to accelerate cooling — and reduce sedimentation); and v. removing the hardened stick from the mold and storing in a cool dry place until used.

Wheel 4 includes 25 v/o, 60/80 mesh cubic boron nitride grains 10 set in wheel bond 8 and is a 16 ×2 inch size. Wheel 4 is mounted in a grinder (Cincinnati Cylindrical) and is operated at 5500 SFPM. Workpiece 6 is composed of hardened M 2 steel, 2 inches diameter, HRC 62. The workpiece is rotated at 120 RPM. Grinding is carried out in a conventional fashion and the best finish achieved by wheel 4 is 47AA. Thereafter, stick 2 is made to come in contact with wheel 4 during a spark-out cycle; i.e., the wheel is just touching workpiece 6, without grinding it. Heat of friction melts the tip of stick 2 and produces lapping film 12 containing fine grit on the surface of wheel 4 and the film moves around the wheel and is transferred to workpiece 6 at interface 14. The cubic boron nitride grains 10 are no longer in use and the wheel begins to function as a high speed lapping wheel. After workpiece 6 reaches the desired surface appearance, lapping is complete and the film 12 is rinsed off with cooling fluid or with water. Finish after lapping is 15AA, and therefore, the overall improvement is 32AA units.

Figure 2:
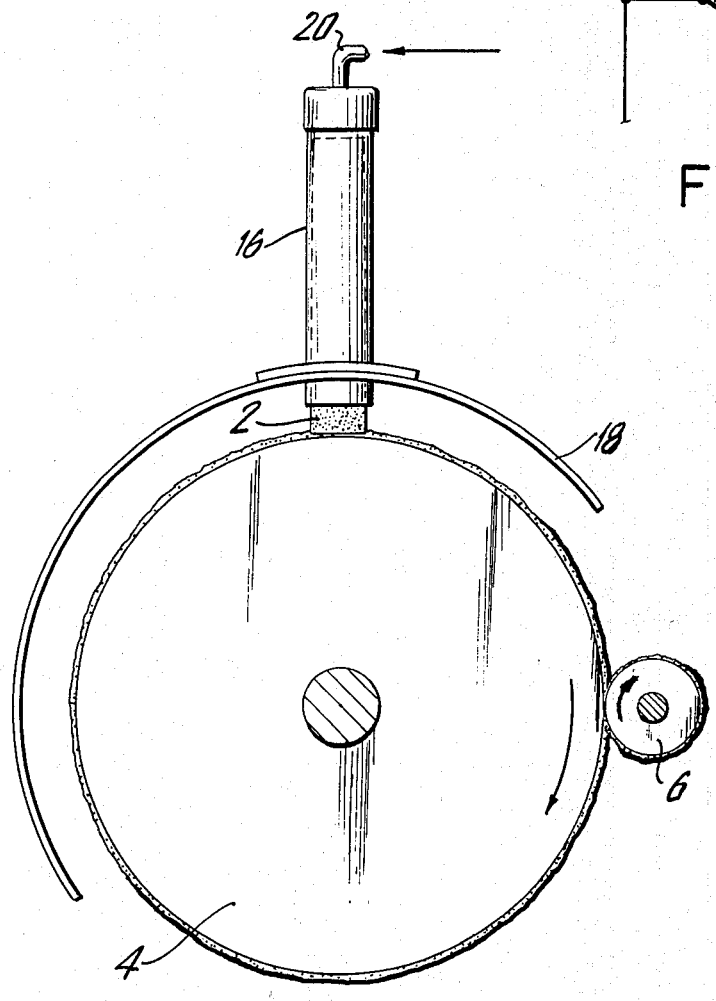
FIG. 2 is a schematic view of a system according to this invention, like that of FIG. 1, but in which the lapping stick is mounted in a magazine.

The hand-held stick technique of FIG. 1 is readily adaptable to automatization. One such technique is shown in FIG. 2 in which stick magazine 16 is installed in wheel guard 18 and stick 2 is fed against wheel 4 rotating in the sparkout cycle against workpiece 6. Conduit 20 is adapted to supply air or vacuum to stick magazine 16 during use to feed the stick under air pressure or to suck it back and hold it when not in use.

Figure 3A:
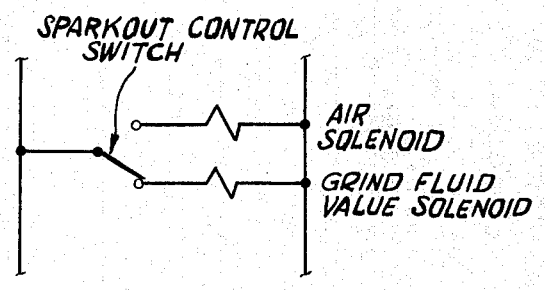
FIG. 3A is a schematic of the stick air control.
Figure 3:
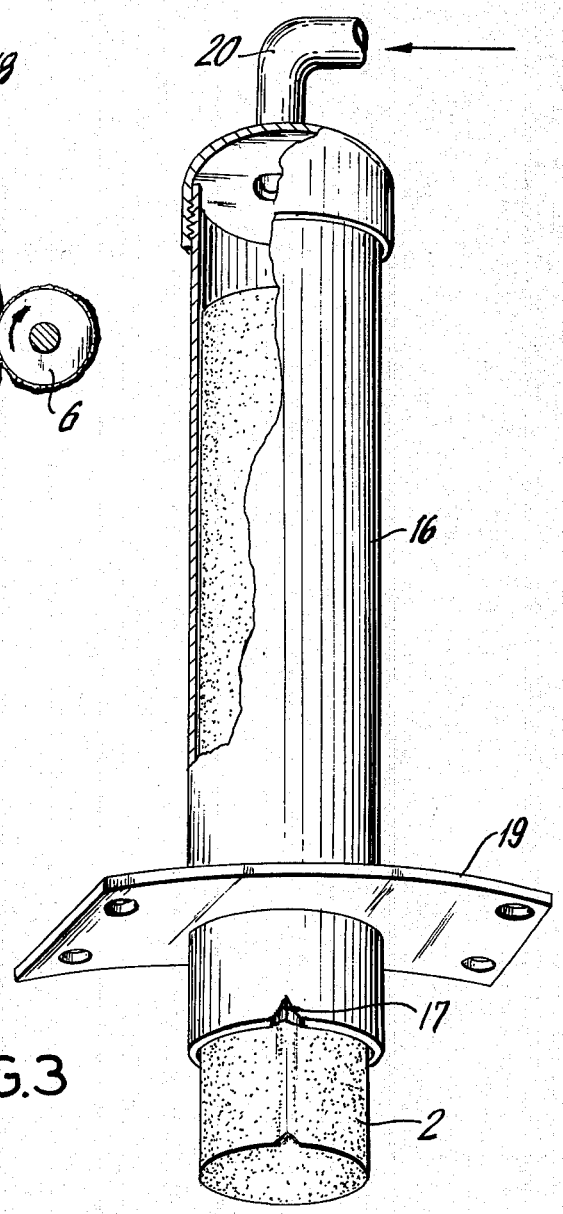
FIG. 3 is a perspective view, partly in section, showing in more detail a lapping stick magazine of the type used in combination shown in FIG. 2.

In an alternative for design of magazine 16, FIG. 3, a small amount of air pressure above stick 2 will drive it. The air can be activated by a solenoid valve, the electrical schematic of which appears in FIG. 3A. The grinding fluid is automatically shut off during the cycle. Afterward with the air shut off, the stick is held by crimp 17 in the outer case of magazine 16 to prevent further use and the fluid will be turned on again. FIG. 3 also shows flange 19 which can be used to mount the magazine on a wheel guard.

It is thus evident that the present invention provides methods for improving the surface of workpieces ground with abrasive wheels. Obviously, many modifications will suggest themselves to those skilled in the art in view of the above detailed description. For example, instead of a polyethylene glycol of the type described above, one having a molecular weight of 1300 to 1600 and a melting point of about 35° to 46° C. can be used. Other organic polymeric matrixes can be used, such as paraffin wax. Instead of a cubic boron nitride abrasive wheel, other abrasives can be used, such as diamond wheels. Instead of aluminum oxide crystals, other fine grit crystals can be used such as cubic boron nitride, diamond, silicon carbide, and the like. Instead of 25 micron grits, crystals ranging from 10 to 100 microns in size can be used. Instead of a mix ratio of 0.6 g./ml., other ratios, such as 0.4 to 1.5 g./ml. can be used. Washing off the lapping compound is contemplated in many embodiments. If polyethylene glycol or other water soluble matrixes are used, the lapping compound retained by the wheel and workpiece is easily removed by flushing with coolant or water. All such obvious variations are within the full intended scope of the invention as defined by the appended claims.

I claim:

1. In a method for grinding metal workpieces on a high speed grinding machine by abrading with a rigid bonded grinding wheel with a predetermined abrading property, the grinding being performed by infeeding the grinding wheel into the workpiece so that material is continuously removed from the workpiece by the contact of grinding wheel, the improvement comprising the subsequent steps of applying to the rotating surface of said grinding wheel, during sparkout while said wheel is rotating at the normal grinding speed, a lapping composition comprising a multiplicity of abrasive crystals having an abrading property different from said grinding wheel dispersed in a normally solid friction-meltable organic polymeric matrix whereby the matrix is melted and the crystals and melted polymer are spread on the surface of the wheel as a lapping layer, and applying said layer against said workpiece until the desired surface finish is achieved.

2. A method as defined in claim 1 wherein said grinding wheel is a diamond grinding wheel.

3. A method as defined in claim 1 wherein said grinding wheel is a cubic boron nitride grinding wheel.

4. A method as defined in claim 1 wherein said abrasive crystals are aluminum oxide crystals or silicon carbide crystals.

5. A method as defined in claim 4 wherein said crystals range from 10 to 100 microns in size.

6. A method as defined in claim 1 wherein said organic polymeric matrix comprises a polyethylene glycol.

7. A method as defined in claim 6 wherein said polyethylene glycol has a molecular weight of about 1300 to 1600 and a melting point of about 35° to 46° C.

8. A method as defined in claim 1 wherein said lapping composition comprises a multiplicity of 25 micron aluminum oxide crystals dispersed in a polyethylene glycol having a molecular weight in the range of 1300–1600 and a melting point of about 38° to 40° C., the mix ratio of aluminum oxide to polyethylene glycol being 0.4 to 1.5 g./ml.

9. A method as defined in claim 1 including the final step, after lapping is complete, of rinsing the lapping composition off the surface of the grinding wheel with grinding fluid or water whereby the wheel is returned to its original grinding configuration.

10. A method as defined in claim 1 wherein said lapping composition is in the form of a stick adapted to be held in the hand and applied against said moving wheel.

* * * * *